US005964616A

United States Patent [19]

Eisenbraun

[11] Patent Number: 5,964,616

[45] Date of Patent: Oct. 12, 1999

[54] LIGHTED ACCESSORY POWER SUPPLY CORD

[75] Inventor: Kenneth D. Eisenbraun, Birmingham, Mich.

[73] Assignee: United Industrial Trading Corp., Troy, Mich.

[21] Appl. No.: 08/976,057

[22] Filed: Nov. 21, 1997

Related U.S. Application Data

[63] Continuation-in-part of application No. 08/607,291, Feb. 26, 1996, Pat. No. 5,690,509

[60] Provisional application No. 60/001,282, Jul. 19, 1995.

[51] Int. Cl.[6] ..... H01R 3/00

[52] U.S. Cl. ..... 439/490; 439/668; 439/910

[58] Field of Search ..... 439/488, 490, 439/639, 638, 668, 669, 910

[56] References Cited

U.S. PATENT DOCUMENTS

| | | | |
|---|---|---|---|
| 4,248,494 | 2/1981 | McDonald et al. | 339/154 |
| 4,319,798 | 3/1982 | Mittelhauser | 339/154 |
| 4,319,799 | 3/1982 | Pearce, Jr. | 339/217 |
| 4,322,122 | 3/1982 | Schwartz et al. | 339/147 |
| 5,007,863 | 4/1991 | Xuan | 439/639 |
| 5,158,484 | 10/1992 | Chou | 439/668 |
| 5,170,067 | 12/1992 | Baum et al. | 307/10.1 |
| 5,201,677 | 4/1993 | Takayama | 439/668 |
| 5,207,594 | 5/1993 | Olson | 439/490 |
| 5,244,409 | 9/1993 | Guss, III et al. | 439/490 |
| 5,326,283 | 7/1994 | Chen | 439/622 |
| 5,431,585 | 7/1995 | Fan | 439/668 |
| 5,690,509 | 11/1997 | Eisenbraun | 439/490 |

*Primary Examiner*—Gary F. Paumen
*Attorney, Agent, or Firm*—Gifford, Krass, Groh, Sprinkle, Anderson & Citkowski, PC

[57] ABSTRACT

An electrical power supply connector is disclosed for use with a vehicle having an electrical distribution system including a cigarette lighter receptacle, the power supply connector comprising an opaque elongated body with a longitudinal axis extending the length of the body and an exterior surface having a perimeter encircling the longitudinal axis. Terminals are positioned near the first end of the body and are adapted to be inserted into the receptacle to make electrical connection with the electrical distribution system. An electrical light source is supported within the connector. Circuitry within the connector is adapted to electrically connect the light source to the electrical distribution system to energize the light source when the first end of the connector is inserted into the receptacle. A lens encircling on the surface of the body extending directs light from the light source exteriorly of the body. When the first end of the connector is in electrical engagement with the electrical distribution system, the lens is visible to an observer regardless of rotational orientation of the connector about its longitudinal axis.

7 Claims, 3 Drawing Sheets

LIGHTED ACCESSORY POWER SUPPLY CORD

REFERENCE TO RELATED APPLICATION

This application is a continuation-in-part of U.S. patent application Ser. No. 08/607,291, filed Feb. 26, 1996, (now issued on Nov. 25, 1997 as U.S. Pat. No. 5,690,509,) which claims the benefit of U.S. provisional application Ser. No. 60/001,282, filed Jul. 19, 1995.

FIELD OF THE INVENTION

The present invention relates generally to an electrical power supply connector which is inserted into a vehicle's cigarette lighter receptacle to supply power to a portable device such as a car stereo, cellular telephone, or lighting device and more particularly to such a device which provides occupants with a direct, line-of-sight view of an illuminated indicator.

BACKGROUND OF THE INVENTION

Prior art electrical power supply connectors of the type suitable for use in a vehicle's cigarette lighter to supply power to a portable device generally have an elongated body having an external surface and a first end and a second end. A flexible electrical cord extends from the second end, while at least two electrically conductive terminals are located near the first end of the connector body. The terminals provide an electrical connection between the vehicle's cigarette lighter receptacle and the flexible electrical cord. Selected prior art connectors provide a light which, when illuminated, indicates that the connector is properly engaged within the receptacle. On prior art devices, this indicator light is not visible unless the connector is in a particular rotational orientation. Because connectors of this type are not typically indexed to fit into a receptacle in a particular rotational orientation, the prior art lights do not consistently provide an indication to occupants of connection status.

In particular, U.S. Pat. No. 5,431,585 discloses a power supply connector having, on its exterior surface, a compass and a lighting device which encircles the compass. The lighting device illuminates the compass and provides an indication of the status of the connection (i.e., properly seated or not properly seated within the receptacle). If the rotational orientation of the power supply connector is such that the compass is not visible to an occupant, the lighting device is also not visible to the occupant. Because receptacles will accept connectors regardless of their rotational orientation, prior art devices of this type fail to consistently provide a direct, line-of-sight indication of the status of the connection.

The present invention is accordingly directed toward a power supply connector suitable for use in a vehicle's cigarette lighter receptacle which provides occupants with a direct, line-of-sight view of an illuminated indicator regardless of the rotational orientation of the connector in the receptacle.

SUMMARY OF THE INVENTION

The present invention solves the problem of prior art power supply connectors which, when inserted into a vehicle's cigarette lighter receptacle, fail to consistently provide an illuminated indication that the connector is either properly seated or that the device attached to the connector is drawing power from the vehicle's electrical distribution system, by providing a lighted lens that encircles the perimeter of the connector such that, regardless of the rotational orientation of the power supply connector in the vehicle's cigarette lighter receptacle, the lens is directly viewable by the vehicle's occupants.

The connector is typically elongated in shape, having a longitudinal axis and a first end and a second end. The first end of the connector is insertable into the vehicle's cigarette lighter receptacle regardless of the connector's rotational orientation about its longitudinal axis. The receptacle is in electrical contact with the vehicle's electrical distribution system. The connector includes a housing having a perimeter which encircles the longitudinal axis. Terminals are positioned near the first end such that, when the connector is inserted into the cigarette lighter receptacle, the terminals are in electrical contact with the receptacle.

A flexible electrical cord having a first end in electrical connection with the terminals and a second end which is positioned exteriorly of the connector and is suitable for attachment to an electrical device such as a portable compact disc player or lighting device.

A lens supported in the body is positioned along the perimeter of the connector housing encircling the longitudinal axis such that the lens is visible regardless of the rotational orientation of the connector. For example, the lens could encircle the body intermediate its ends or be positioned on the distal end of the connector.

A light source is positioned within the connector housing such that light is directed toward the lens. The light source is electrically connected to the terminals, providing an indication that the connector is either fully engaged to the receptacle or that the portable device attached to the cord is drawing power from the vehicle's electrical distribution system.

In a different embodiment of the invention, the illumination means are disposed on a power receptacle in the form of a body including a socket adapted to receive a male connector of the type configured for insertion into a cigarette lighter. Preferably, a light-transmissive lens is mounted on the outer side wall of the body to radiate light from the lamp outwardly therefrom. The lens may be in the form of a ring encircling the body anywhere along its length, including the area immediately surrounding the socket end.

A power cord emanates from the body, which may terminate either in a male connector of the type adapted for insertion into a cigarette-lighter receptacle, thereby creating an extension cord for use in vehicles providing such receptacles, or, alternatively, the power cord may terminate in a different type of connector or as bare wires for connection to an electrical system, fuse block or source of power. In the extension cord embodiment, the male end of the cord may, or may not, include the illumination means described herein, for example, with respect to FIGS. 1–4.

Other objects, advantages and application of the present invention will be made clear by the following detailed description of a preferred embodiment of the invention. The description makes reference to drawings in which:

DETAILED DESCRIPTION OF THE INVENTION

Figure 1:
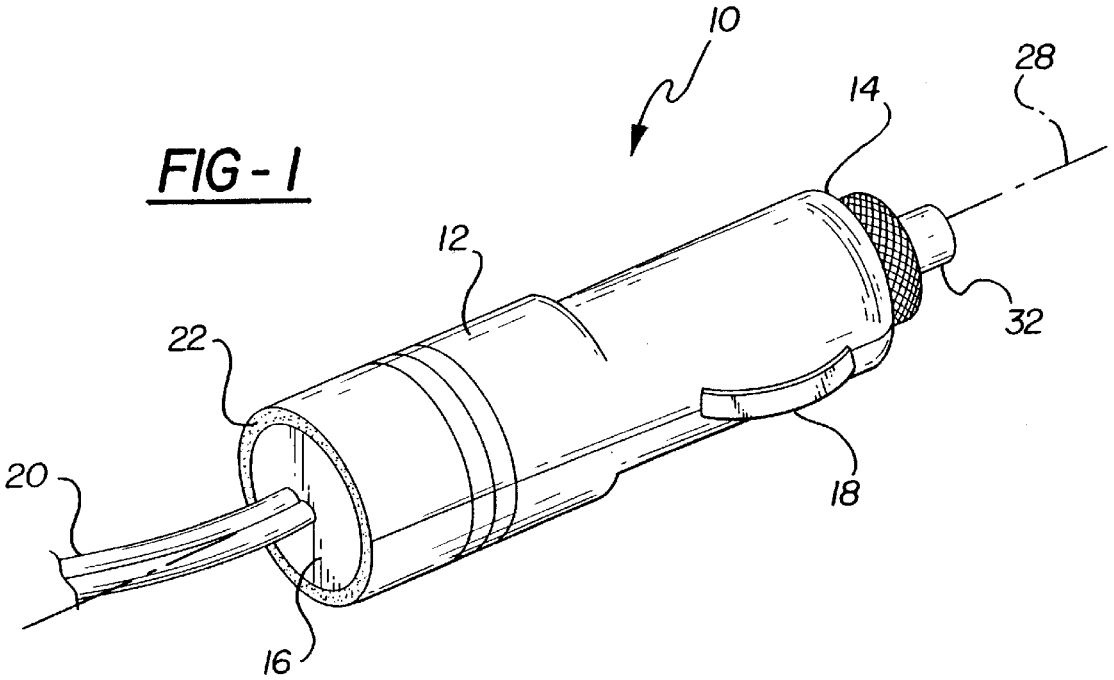
FIG. 1 is a perspective view of the invention.
Figure 2:
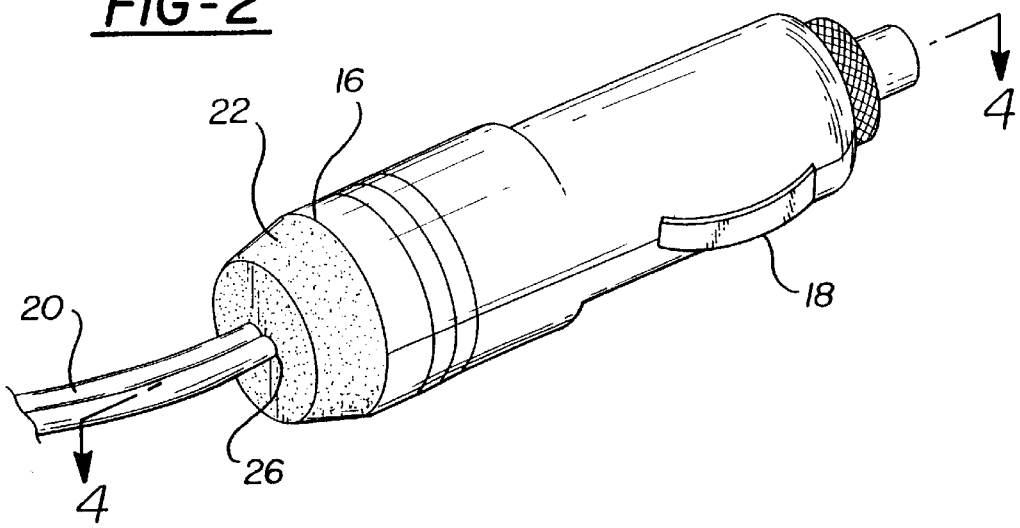
FIG. 2 is an alternate embodiment of the present invention.
Figure 3:
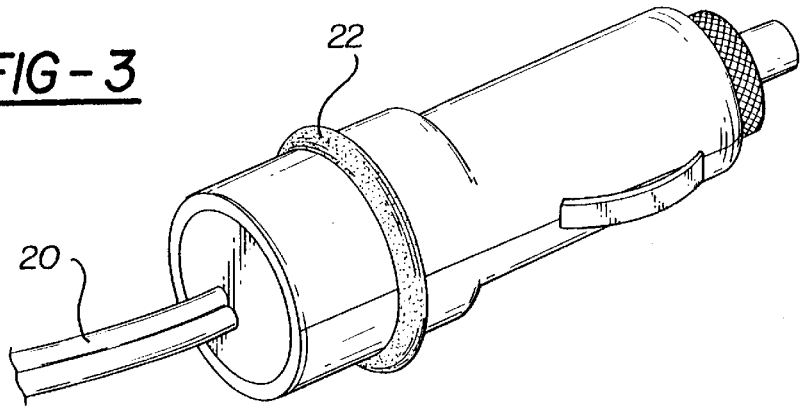
FIG. 3 is another alternate embodiment of the present invention.
Figure 4:
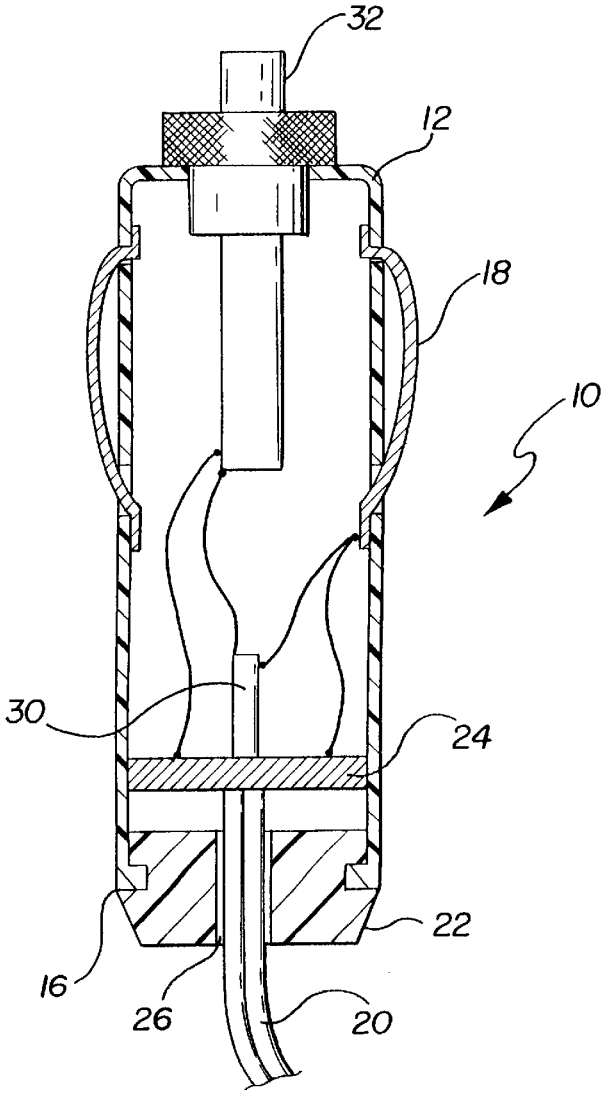
FIG. 4 is a cross-sectional view of the invention depicted in FIG. 2.

The invention, as shown in FIG. 1, is an electrical power connector 10 having a housing 12 having an exterior surface and first and second ends, 14 and 16 respectively. The connector 10 is inserted into a vehicle's cigarette lighter receptacle (not shown) which is in electrical contact with the vehicle's electrical distribution system (also not shown). As depicted in FIGS. 1 and 4, an electrically conductive terminals 18 and 32 are positioned near the first end 14 such that, when the connector 10 is inserted into the receptacle, the terminals 18 and 32 are in electrical contact with the receptacle. As shown in FIG. 4, terminal 18 is in electrical communication with the end 30 of electrical cord 20 and light source 24. The flexible electrical cord 20 extends from the second end 16 and has an end suitable for attachment to an electrical device (not shown). A lens 22 supported in the housing 12 is positioned on the exterior of the housing 12 such that the lens 22 is visible regardless of the rotational orientation of the connector 10 about its longitudinal axis 28 within the receptacle. As shown in FIG. 1, the lens 22 is positioned on the second end 16 of the connector body 10. FIG. 2 illustrates an embodiment wherein the lens 22 completely covers the second end 16 and the cord 20 passes through an aperture 26 in the lens 20. In FIG. 3, the lens 22 is positioned on the exterior surface and intermediate the ends of housing 12. As clearly shown in FIGS. 1, 2 and 3, the housing 12 is opaque.

Alternatively, a plurality of lenses could be used to achieve the same effect as the lenses illustrated in FIGS. 1, 2 and 3. For example, a series of short lens segments placed in close proximity to each other along the perimeter of the exterior surface of housing 12 provides a visual effect similar to a lens which is a single ring positioned on the exterior surface of housing 12.

Lenses may be colored or clear, and may be of any cross-sectional shape, such as rectangular, triangular or circular. Lenses may be printed with writing or symbols such that the words or symbols are illuminated.

As shown in FIG. 4, a light source 24 is positioned within the connector 10 such that light is directed towards the lens 22. The light source 24 is electrically connected to the terminals 18 and 32, providing an indication that the connector 10 is either fully engaged to the receptacle or that the portable device attached to the cord 20 is drawing power from the vehicle's electrical distribution system. The light source may have a variety of configurations, such as a light emitting diode (LED), shown in FIG. 4, or a bulb and socket arrangement.

Alternatively, a connector 10 may be provided with multiple light sources and lenses, one light source and lens indicating that the connector is electrically connected to the receptacle, and another light source and lens indicating that the device is drawing power from the vehicle.

Figure 5:
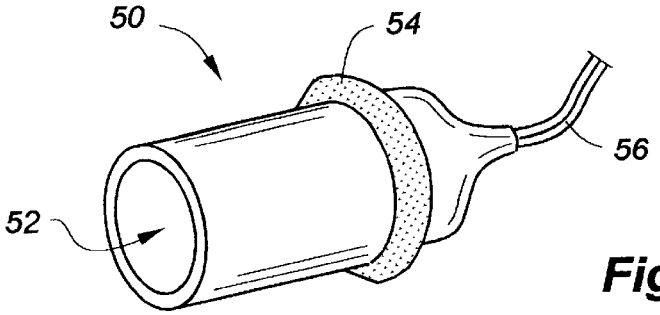
FIG. 5 depicts an alternative embodiment including a socket adapted to receive a male connector of the type configured for insertion into a cigarette lighter receptacle.

In FIG. 5 there is depicted generally at 50 an alternative embodiment of the invention wherein a body including a socket 52 into which a male connector of the type adapted for insertion into a cigarette lighter receptacle may be installed, including an connector of the type described previously with reference to FIGS. 1–4. In this embodiment of the invention, an illuminated lamp is disposed so as to be visible outwardly of the body, preferably in the shape of a ring which circumferentially encircles a portion of the body along its length, enabling light therefrom to be viewed at any angle, as shown by lens 54.

A power cord, 56, emanates from the body, and may be connected to another connector, including a male connector of the type adapted for insertion into a cigarette lighter receptacle, including illuminated connectors of the type depicted in FIGS. 1–4, but not necessarily so. As an alternative, the power cord 56 may connect to some other type of connector such as spade/lug terminals, or bare wires or any other means for connection to a source of power, fuse block, and the like.

Figure 7:
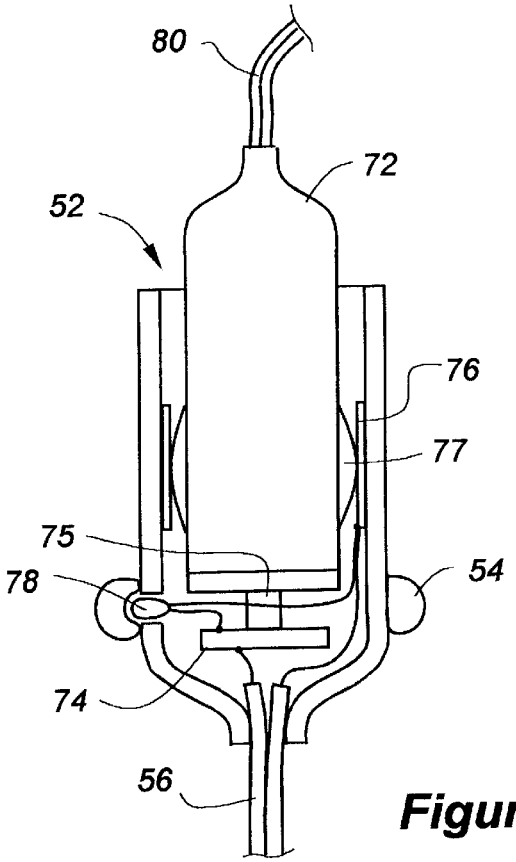
FIG. 7 illustrates an illuminated socket, including a male connector installed therein along with respective wiring.

FIG. 7 illustrates an illuminated socket according to the invention into which there is installed a male connector 72 having wiring 80 extending therefrom, this connector being inserted into the inventive illuminated socket through opening 52. So located, the male connector, typically having spring-loaded side electrodes 77, may contact with an encircling inner metallic ring 76 making electrical connection to the power cord 56. To complete the circuit, the end electrode 75, which may be spring loaded, makes connection to an electrically conductive plate 74 which connects to the other side of the electrical service through cord 56.

In parallel with this circuit there is connected a bulb 78, which becomes illuminated as power is delivered through cord 56 into the body of the connector. The bulb 78 may either protrude through the side wall of the body of the connector to make optical contact with a lens such as 54, or, alternatively, the lens element 54 may be integrally molded into side wall itself with non-transmissive sections being opaque. A current-limiting resistor (not shown) may be connected in series with the bulb 78 though, depending upon the resistance of the bulb, may not be necessary in all instances. As an alternative to, or in conjunction with a lens, regardless of its positioning relative to the outer body of the inventive connector, two or more lamps may be utilized, all of which preferably become illuminated when power is delivered to the connector body.

Having described the various embodiments of the present invention with reference to the accompanying figures, it will be appreciated that various changes and modifications can be made without departing from the scope or spirit of the invention.

I claim:

1. A power receptacle, comprising:

a body having a proximal end, a distal end, and an outer sidewall therebetween;

a power cord having proximal and distal ends, the distal end of the cord entering into the proximal end of the body to carry electrical power thereinto; the distal end of the body including a socket adapted to receive a male connector of the type configured for insertion into a cigarette lighter;

an electrical lamp in communication with the power cord such that when electrical power is carried to the body the lamp is illuminated;

a light-transmissive lens surrounding at least a portion of the outer sidewall of the body to radiate light from the lamp outwardly of the body.

2. The power receptacle of claim 1, wherein the outer sidewall is substantially cylindrical.

3. The power receptacle of claim 2, wherein the lens encircles the socket.

4. The power receptacle of claim 1, further including a male connector of the type configured for insertion into a cigarette lighter attached to and in electrical communication with the proximal end of the power cord.

5. An electrical extension cord, comprising:

first and second electrical connectors in electrical communication with one another by way of a power cord;

the first connector being a male connector of the type configured for insertion into a cigarette lighter; and the second connector including an outer sidewall and a socket adapted to receive a male connector of the type configured for insertion into a cigarette lighter;

the second connector further including an electrical lamp in communication with the power cord such that when electrical power is carried to the second connector from the first connector the lamp is illuminated; and a light-transmissive lens surrounding at least a portion of the outer sidewall of the second connector to radiate light from the lamp outwardly of the second connector.

6. The electrical extension cord of claim 5, wherein the outer sidewall of the second connector is substantially cylindrical.

7. The electrical extension cord of claim 6, wherein the lens encircles the socket.

* * * * *

UNITED STATES PATENT AND TRADEMARK OFFICE

CERTIFICATE OF CORRECTION

PATENT NO. : 5,964,616

DATED : Oct. 12, 1999

INVENTOR(S) : Kenneth D. Eisenbraun

It is certified that error appears in the above-identified patent and that said Letters Patent are hereby corrected as shown below:

Column 3, line 18 - Between "4 and electrically" delete --an--

Column 4, line 2 - Replace "an" with --a--

Figure 6:
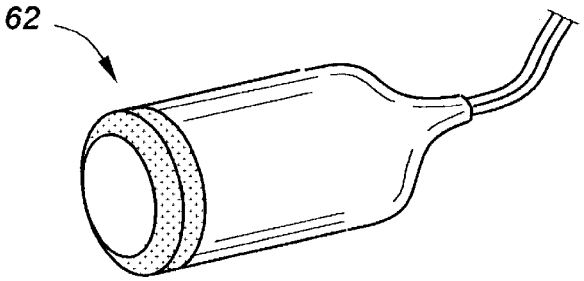
FIG. 6 illustrates the use of an illumination means located directly around socket entry into the body of the invention of FIG. 5.

Column 4, line 8 - After "54" insert --Figure 6 shows an alternative to this position, in which lens 62 is located directly around socket entry into the body.--

Signed and Sealed this

Tenth Day of April, 2001

*Attest:*

Nicholas P. Godici

NICHOLAS P. GODICI

*Attesting Officer*

*Acting Director of the United States Patent and Trademark Office*